US006237451B1

(12) United States Patent
Wei

(10) Patent No.: US 6,237,451 B1
(45) Date of Patent: May 29, 2001

(54) TOOL BOX

(76) Inventor: Yong Lung Wei, 1F, 1, Alley 16, Lane 40, Jinn Te Rd., Taichung (TW)

( * ) Notice: Subject to any disclaimer, the term of this patent is extended or adjusted under 35 U.S.C. 154(b) by 0 days.

(21) Appl. No.: 09/534,611

(22) Filed: Mar. 27, 2000

(51) Int. Cl.[7] ..... B25G 1/08
(52) U.S. Cl. ..... 81/490; 81/177.4
(58) Field of Search ..... 81/490, 177.4

(56) References Cited

U.S. PATENT DOCUMENTS 3,426,813 * 2/1969 Robertson ..... 81/490
4,227,430 * 10/1980 Jansson et al. ..... 81/177.4
4,926,721 * 5/1990 Hsiao ..... 81/177.4
5,174,178 * 12/1992 Disston, Jr. ..... 81/490
5,217,116 * 6/1993 Ku ..... 81/490
5,740,706 * 4/1998 Tseng ..... 81/490
5,875,692 * 3/1999 Lin ..... 81/58.3

* cited by examiner

*Primary Examiner*—James G. Smith
*Assistant Examiner*—Lee Wilson

(57) ABSTRACT

A tool box includes a body having an engaging hole in an outside thereof and two protrusions respectively extend from two ends of the body. Each protrusion has a plurality of recesses for receiving bits therein. Each protrusion has a cover mounted thereto and the cover has an aperture defined therethrough. The aperture is in alignment with one of the recesses so that a bit can be picked via the aperture and engaged with the engaging hole in the body.

4 Claims, 5 Drawing Sheets

TOOL BOX

FIELD OF THE INVENTION

The present invention relates to a tool box having a body with an engaging hole in the outside thereof and two protrusions respectively extending from two ends of the body. Each protrusion has recesses for receiving bits therein and two covers each having a hole are respectively mounted to the two protrusions.

BACKGROUND OF THE INVENTION

A conventional tool box is shown in FIG. 1 and includes a base 100 and a cover 200 which is connected to the base 100 by a snap device 201. The base 100 has a plurality of recesses defined therein for receiving tools and bits therein. When using the tools or the bits, the user opens the cover 200 and picks the tool and the bit. The conventional tool box simply provides a function for retaining the tools and the bits. The bits are cooperated with a tool which occupies a lot of space and in order to receive the tool in the tool box, the tool box has to be made large enough. However, the large tool box is inconvenient for transportation and storage. A bit box is then developed and receives bits and engaging parts only. Although the bit box collects the variety of bits so that the user can choose the bits to be used and receives the bits in a bit box, a tool such as a ratchet tool is still carried with the user. In other words, there still needs a box to receive the ratchet tool.

The present invention intends to provide an improved tool box which retains a lot of bits and can engage a bit and is used as a tool. Accordingly, the tool box has two functions one of which is to receive bits therein and the other function is to engage a bit in an engaging hole defined in the outside of the tool box and used as a tool screwdriver.

SUMMARY OF THE INVENTION

In accordance with one aspect of the present invention, a tool box is provided and comprises a body having an engaging hole defined in an outside thereof, and a protrusion extends from at least one of two ends of the body. The protrusion has a plurality of recesses radially defined in a periphery thereof so as to receive bits therein. A cover is rotatably mounted to the body and receives the protrusion in the cover. The cover has an aperture which is in alignment with one of the recesses so that a bit can be picked via the aperture and engaged with the engaging hole so that the user may rotate the tool box to rotate the bit.

The main object of the present invention is to provide a tool box which receives a plurality of bits and the tool box can be engaged with one of the bits so as to output a torque by rotating the body of the tool box.

Further objects, advantages, and features of the present invention will become apparent from the following detailed description with appropriate reference to the accompanying drawings.

DETAILED DESCRIPTION OF THE PREFERRED EMBODIMENTS

Figure 1:
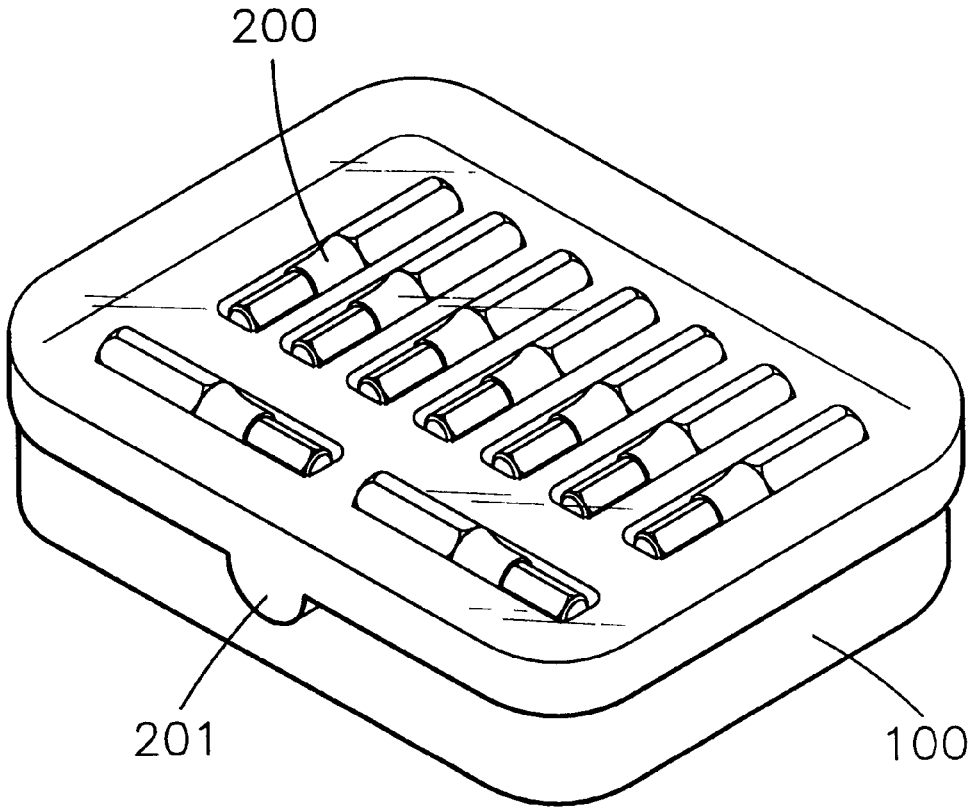
FIG. 1 PRIOR ART
FIG. 1 is a perspective view of a conventional tool box.
Figure 2:
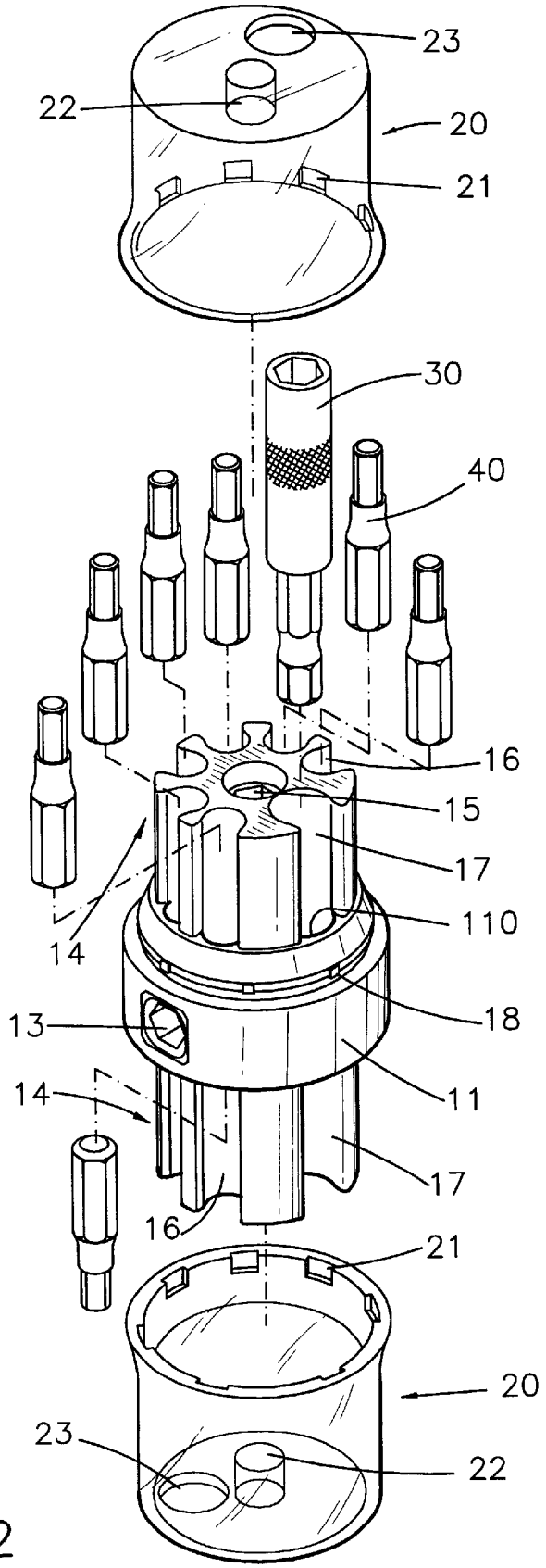
FIG. 2 is an exploded view of the tool box and covers in accordance with the present invention and bits to be received in the tool box of the present invention.
Figure 3:
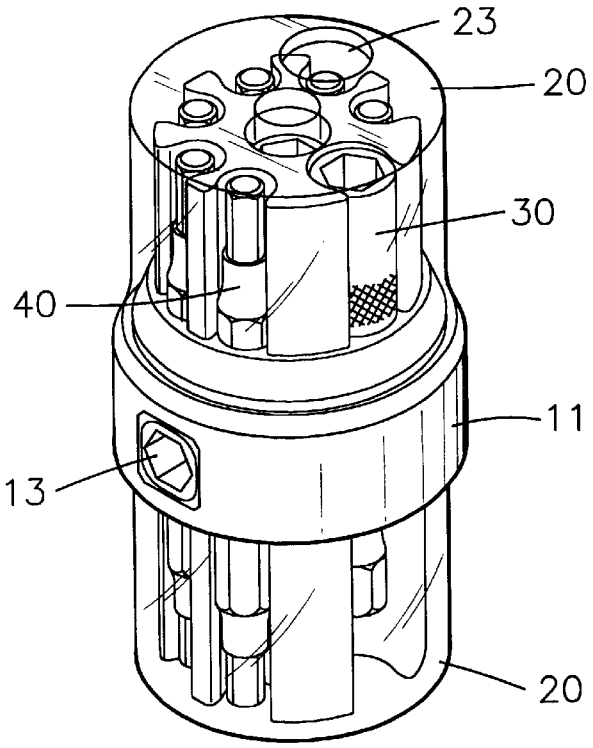
FIG. 3 is a perspective view of the tool box of the present invention with bits received thereon.
Figure 4:
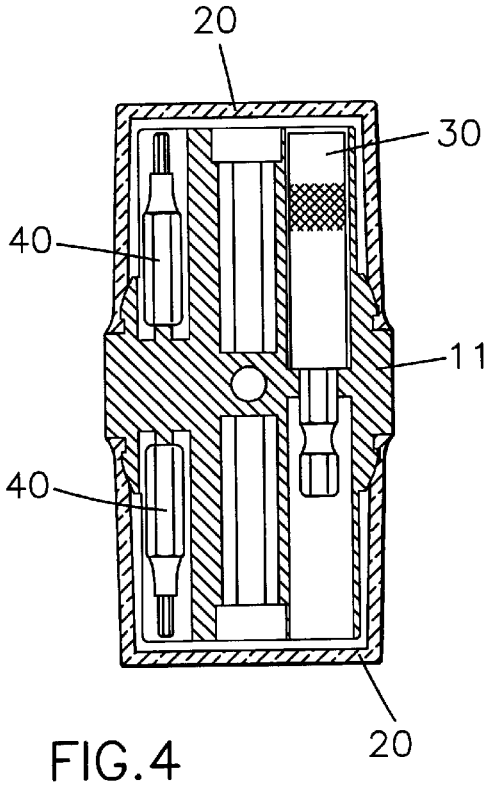
FIG. 4 is a side elevational view, partly in section, of the tool box and the bits in the toolbox.

Referring to FIGS. 2 to 4, the tool box of the present invention comprises a circular body 11 having an engaging hole 13 defined in an outside thereof so as to engage with a bit 40. Each of two ends of the body 11 has a protrusion 14 extending therefrom and each protrusion 14 has a plurality of recesses 16 radially defined in a periphery thereof so that each recess 16 receives a bit 40. The body 11 has a passage 110 which communicates with one of the recesses 16, therefore, a long bit engaging member 30 extends through the passage 110 and is received in the two alignment recesses 17 of the two protrusions 14. Each protrusion 14 has a hole 15 defined in a distal end thereof and the body 10 has a plurality of bosses 18 extending radially outward therefrom.

Figure 5:
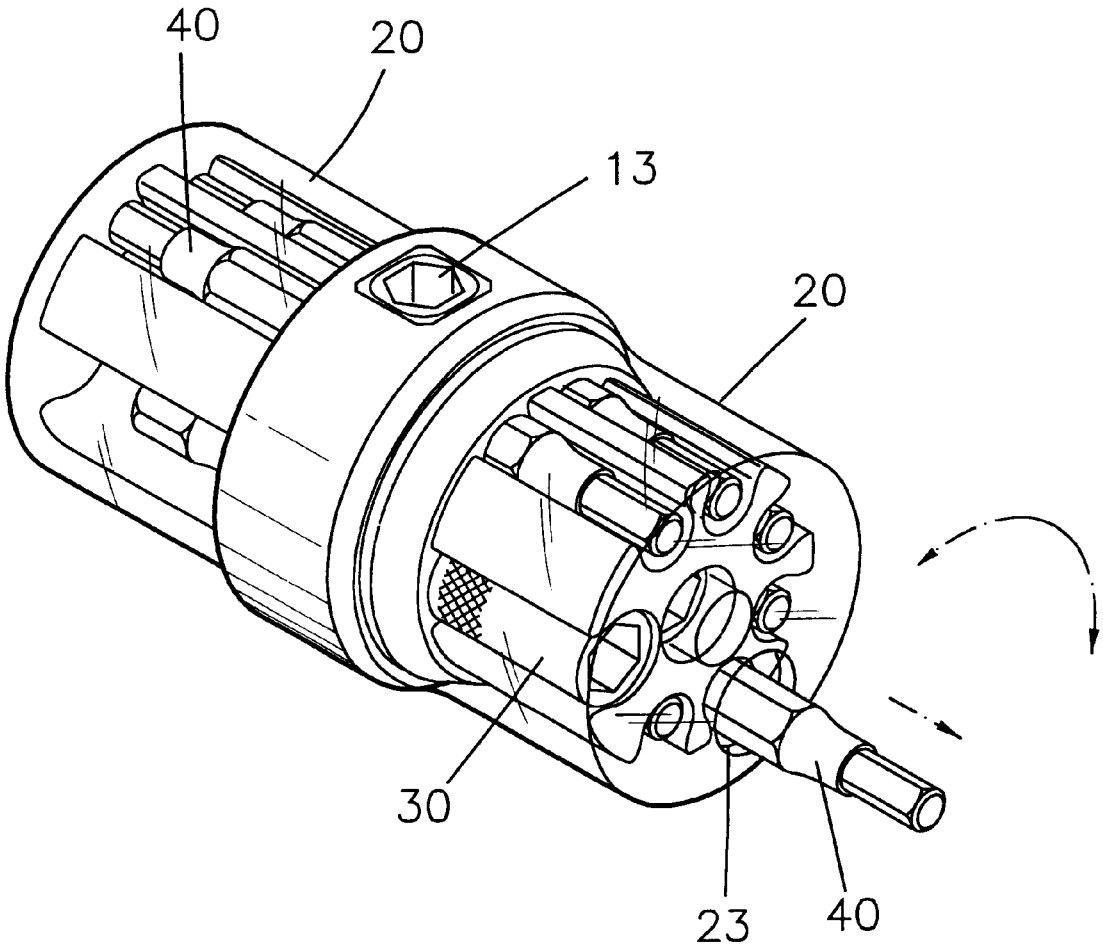
FIG. 5 is a perspective view to show a bit is picked via an aperture in the cover.

Two transparent covers 20 are rotatably mounted to the body 11 and receive the two protrusions 14 in the two covers 20. Each cover 20 has an aperture 23 which is in alignment with one of the recesses 16 so that a bit 40 can be picked via the aperture 23 of the cover 20 when the aperture 23 is moved to be in alignment with the bit 40 as shown in FIG. 5. Each cover 20 has a tubular member 22 extending from an inside of the cover 20 so as to be receive in the hole 15, and each cover 20 has a plurality of notches 21 defined in an inside thereof so that the bosses 18 are engaged with the notches 21. The engagement between the bosses 18 and the notches 21 provides an indexing function to the user to index that when he/she rotates the cover 20, the aperture 23 is located in alignment with one of the recesses 16. The engagement between the tube 22 and the hole 15 in the protrusion 14 prevents the cover 20 from shifting away from the protrusion 14.

Figure 6:
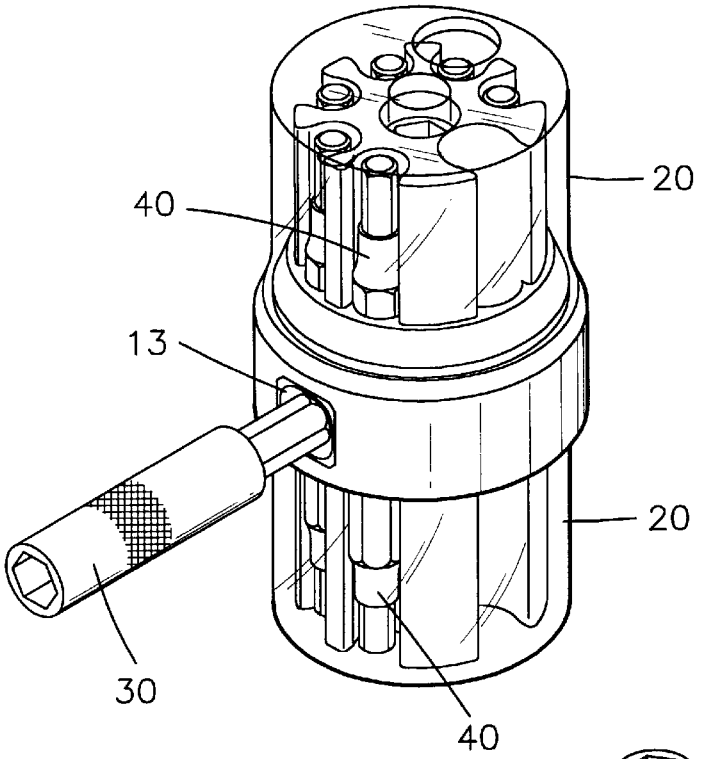
FIG. 6 is a perspective view to show the bit picked is engaged with the engaging hole of the body of the tool box of the present invention.

As shown in FIG. 6, the long bit engaging member 30 can be engaged with the engaging hole 13 in the body 11 and a bit 40 can be connected to the long bit engaging member 30 so that the user may hold the tool box and rotate the tool box to use as a screwdriver.

Figure 7:
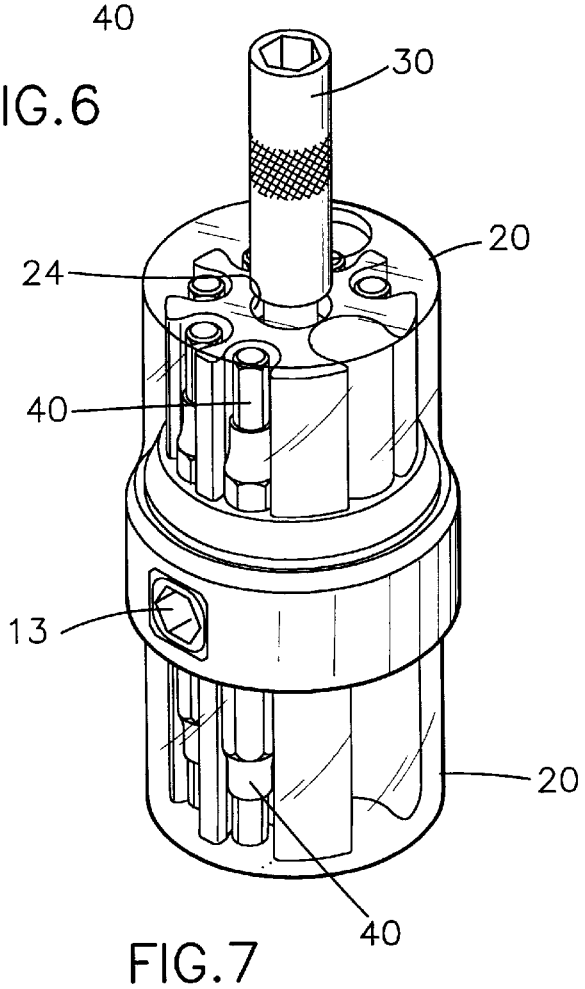
FIG. 7 is a perspective view to show another embodiment of the tool box wherein the bit picked is inserted into the engaging hole in the protrusion via the cover.

FIG. 7 shows another embodiment of the tool box wherein the cover 20 has a central aperture 24 which is located in alignment with the hole 15 so that the long bit engaging member 30 and/or the bit can be engaged with the hole 15 in the protrusion.

The invention is not limited to the above embodiment but various modification thereof may be made. It will be understood by those skilled in the art that various changes in form and detail may made without departing from the scope and spirit of the present invention.

What is claimed is:

1. A tool box comprising:

a body having an engaging hole defined in an outside thereof, at least one of two ends of said body having a protrusion extending therefrom, said protrusion having a plurality of recesses radially defined in a periphery thereof, a plurality of bosses extending radially outward from said body, and a cover having a plurality of notches defined in an inside thereof and said bosses engaged with said notches so that said cover is rotatably mounted to said body and receives said protrusion in said cover, said cover having an aperture which is in alignment with one of said recesses.

2. The tool box as claimed in claim 1, wherein said protrusion has a hole defined in a distal end thereof, a tubular member extending from an inside of said cover so as to be receive in said hole.

3. The tool box as claimed in claim 1, wherein said protrusion (13) has a hole (15) defined in a distal end thereof and said cover (20) has a central aperture (24) which is located in alignment with said hole (15).

4. The tool box as claimed in claim 1, wherein said body has a passage which communicates with one of said recesses.

* * * * *